US008413850B1

(12) United States Patent
Gambach et al.

(10) Patent No.: US 8,413,850 B1
(45) Date of Patent: Apr. 9, 2013

(54) PUMP DEVICE FOR BOTTLES

(76) Inventors: Fernando Gambach, Hollywood, FL (US); Yael Gambach, Hollywood, FL (US)

( * ) Notice: Subject to any disclaimer, the term of this patent is extended or adjusted under 35 U.S.C. 154(b) by 212 days.

(21) Appl. No.: 12/860,383

(22) Filed: Aug. 20, 2010

Related U.S. Application Data

(60) Provisional application No. 61/238,933, filed on Sep. 1, 2009.

(51) Int. Cl.
*B67B 1/00* (2006.01)

(52) U.S. Cl.
USPC ..... 222/153.13; 222/333; 222/523

(58) Field of Classification Search ..... 222/153.13, 222/333, 566, 383.1, 523; 239/332, 333
See application file for complete search history.

(56) References Cited

U.S. PATENT DOCUMENTS 3,173,584 A * 3/1965 Giavasis ..... 222/263
3,352,497 A * 11/1967 Abramson ..... 239/332
3,565,344 A * 2/1971 Takei et al. ..... 239/332
3,825,156 A * 7/1974 Nobuo ..... 222/183
4,154,375 A * 5/1979 Bippus ..... 222/325
4,566,611 A * 1/1986 Sukopp ..... 222/153.13
4,595,121 A 6/1986 Schultz
4,667,856 A 5/1987 Nelson
D300,896 S 5/1989 Hagan et al.
5,014,884 A * 5/1991 Wunsch ..... 222/333
5,326,003 A 7/1994 Kitto et al.
5,529,223 A 6/1996 Fisher
6,820,774 B2 11/2004 Jones
6,851,584 B2 2/2005 White
6,869,035 B2 * 3/2005 Doud ..... 239/588

* cited by examiner

*Primary Examiner* — Kevin P Shaver
*Assistant Examiner* — Daniel R Shearer

(57) ABSTRACT

A pump device with a base for inserting into a top of a bottle and a straw disposed on a second end of the base and extending into the bottle. The straw serves as a conduit for liquid in the bottle to travel to the base. A button is slidably disposed in the base for operating an electric pump disposed in the base and can move between a first position and a second position. Movement of the button to the second position causes activation of the electric pump. A pump extension component is disposed on the button and is fluidly connected to the base conduit to serve as a conduit for the liquid to travel out of the pump device. The pump extension component is adjustable in length.

6 Claims, 5 Drawing Sheets

PUMP DEVICE FOR BOTTLES

FIELD OF THE INVENTION

The present invention is directed to a cap for a bottle, more particularly to a bottle cap comprising a pump for pumping liquid out of the bottle. The present invention is a non-provisional patent application which claims benefit to the provisional application Ser. No. 61/238,922, filed Sep. 1, 2009, the disclosure of which is incorporated in its entirety by reference herein.

BACKGROUND OF THE INVENTION

Many beverage containers, such as two liter bottles, gallon jugs, and cartons, require the user to open a cap, pick up the bottle, and pour out the liquid. The present invention features a pump device for bottles (or other containers such as jugs, etc.) for pumping liquid out of the bottles. The pump device can eliminate the need for a user to pick up the bottle and turn it upside down to access the liquid. In some embodiments, the pump device can allow a user to access the contents of the bottle from a certain distance (e.g., in the back of the refrigerator).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
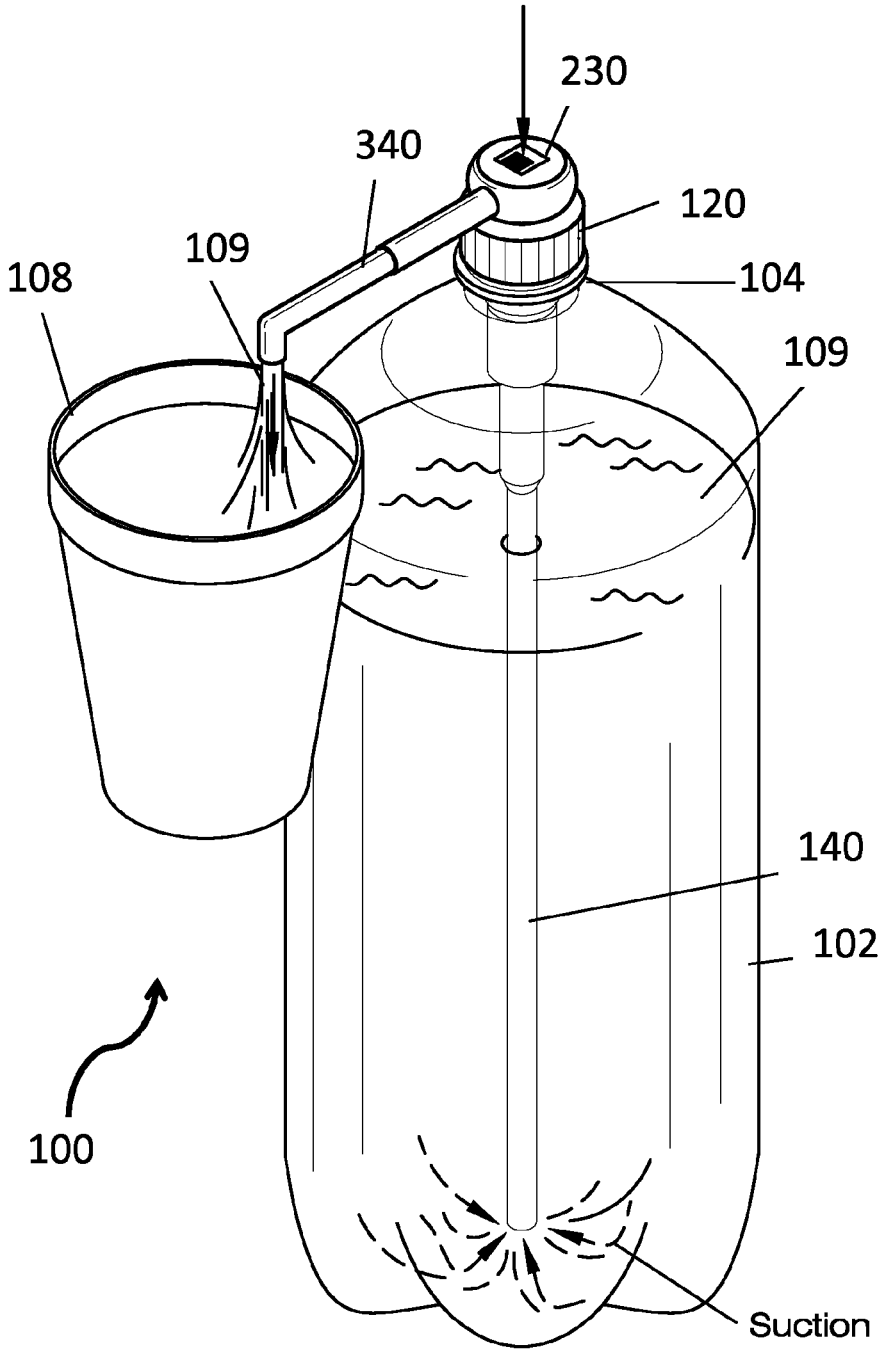
FIG. 1 is a perspective view of the bottle cap pump device of the present invention as attached to a bottle.
Figure 2:
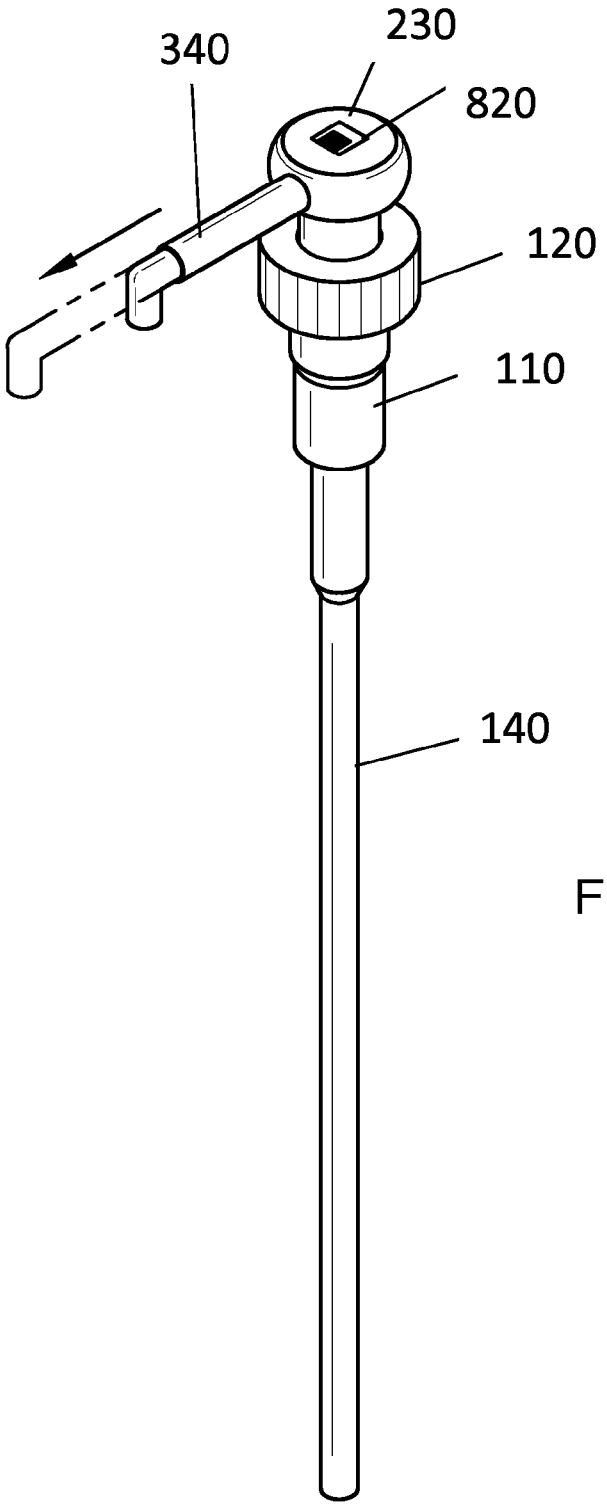
FIG. 2 is a perspective view of the bottle cap pump device of FIG. 1.
Figure 3:
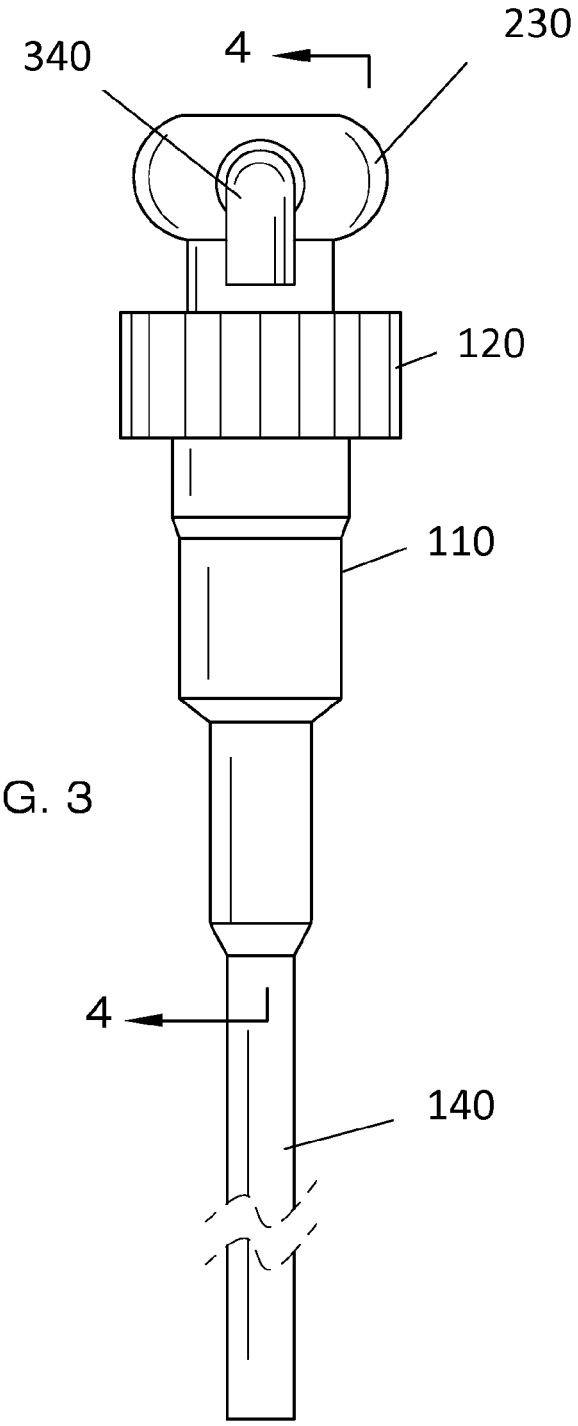
FIG. 3 is a front view of the bottle cap pump device of FIG. 1.

Referring now to FIGS. 1-5, the present invention features a bottle cap pump device 100. The device 100 of the present invention can be attached to the top 104 of a bottle 102 such as a 1-liter, 2-liter bottle, jug (e.g., gallon jug), etc. Without wishing to limit the present invention to any theory or mechanism it is believed that the device 100 of the present invention is advantageous because it provides an easy means of dispensing liquid 109 from a bottle 102 via a pump mechanism and can allow a user to access the contents (e.g., liquid 109) of the bottle 102 from a certain distance (e.g., in the back of the refrigerator). The device 100 of the present invention may also allow flow regulation, for example a user can have a faster/bigger flow to fill a cup (on the 1 or 2 liter bottle), or the user can have a slower/smaller flow to pour the liquid (on the jug such as a gallon jug).

The bottle cap pump device 100 comprises a generally hollow and cylindrical base 110 for inserting into to the top 104 of the bottle 102. The base 110 has a first end that generally is positioned at the top 104 of the bottle 102 and a second end that extends into the bottle 102 (e.g., into the inner cavity). Disposed on the first end of the base 110 is an outer cylinder 120 (see FIG. 4) comprising threads 125 (see FIG. 4) that allow the device 100 to be screwed onto the top 104 of the bottle 102. In some embodiments, a straw 140 is disposed on the second end of the base 110 serving as a conduit for the liquid 109 in the bottle 102 to travel through the base 110.

The straw 140 may be constructed in a variety of sizes. For example, in some embodiments, the straw 140 is between about 6 to 8 inches in length as measured from a first end to a second end. In some embodiments, the straw 140 is between about 8 to 10 inches in length as measured from a first end to a second end. In some embodiments, the straw 140 is between about 10 to 12 inches in length as measured from a first end to a second end. In some embodiments, the straw 140 is between about 12 to 13 inches in length. In some embodiments, the straw 140 is more than about 13 inches in length.

For example, in some embodiments, a straw 140 with a length of between about 12 to 13 inches (e.g., 12.5 inches) may be used for a two liter bottle (two liter bottles are well known to one of ordinary skill in the art. In some embodiments, a straw 140 with a length of between about 9 to 10 inches (e.g., 9.5 inches) may be used for a gallon bottle (gallon bottles are well known to one of ordinary skill in the art. In some embodiments, a straw 140 with a length of between about 9 to 11 inches may be used for a carton beverage (cartons are well known to one of ordinary skill in the art. The present invention is not limited to the aforementioned examples.

Atop the base 110 (and outer cylinder 120) is a button 230 for operating the pump components. The button 230 is similar to standard buttons on pump systems, which are well known to one of ordinary skill in the art. For example, the button 230 can move between a first position and a second position (e.g., up and down respectively, in a first direction and second direction, respectively, etc.), and movement between the first and second position causes liquid 109 to be pumped from the bottle 102. In some embodiments, the button 230 is biased in the first position caused by a spring 420 (see FIG. 4).

In some embodiments, a battery 810 is disposed in the device 100. For example, a battery 810 may be housed in the button 230. In some embodiments, a battery compartment 820 is disposed in the button 230 (see FIG. 2, FIG. 4) for housing the battery 810.

In some embodiments, a pump extension component 340 is disposed on the base 110 and/or on the button 230, which serves as a conduit for the liquid 109 in the base 110 to travel out of the device 100 (e.g., and into a cup 108). The liquid 109 may travel through the base 110, through the button 230, and then through the pump extension component 340. The pump extension component 340 may be fluidly connected to a conduit 480 (e.g., with rubber seal) in the base 110 (see FIG. 4). The pump extension component 340 may be adjustable in length (e.g., via a telescopic mechanism).

The pump extension component 340 may be constructed in a variety of sizes. For example, in some embodiments, the pump extension component 340 is between about 2 to 8 inches in length as measured from a first end to a second end. In some embodiments, the pump extension component 340 is between about 8 to 14 inches in length as measured from a first end to a second end. In some embodiments, the pump extension component 340 is between about 14 to 20 inches in length as measured from a first end to a second end. In some embodiments, the pump extension component 340 is more than about 20 inches in length. The present invention is not limited to the aforementioned examples. The pump extension component 340 may help to pour to a glass from a bottle located behind another bottle (e.g., situated behind another bottle in the refrigerator).

Disposed in the inner cavity of the base 110 are the pump components that function to pump out liquid 109 from the bottle 102. Pump components are well known to one of ordinary skill in the art. For example, in some embodiments, an electric pump 710 is disposed in the base 110. The electric pump 710 functions to pump liquid from the bottle (via the straw 140) through the base 110 (e.g., via the conduit 480), the button 230 and extension component 340. The electric pump 710 is operatively connected to the battery 810, for example via wiring 830.

Figure 4:
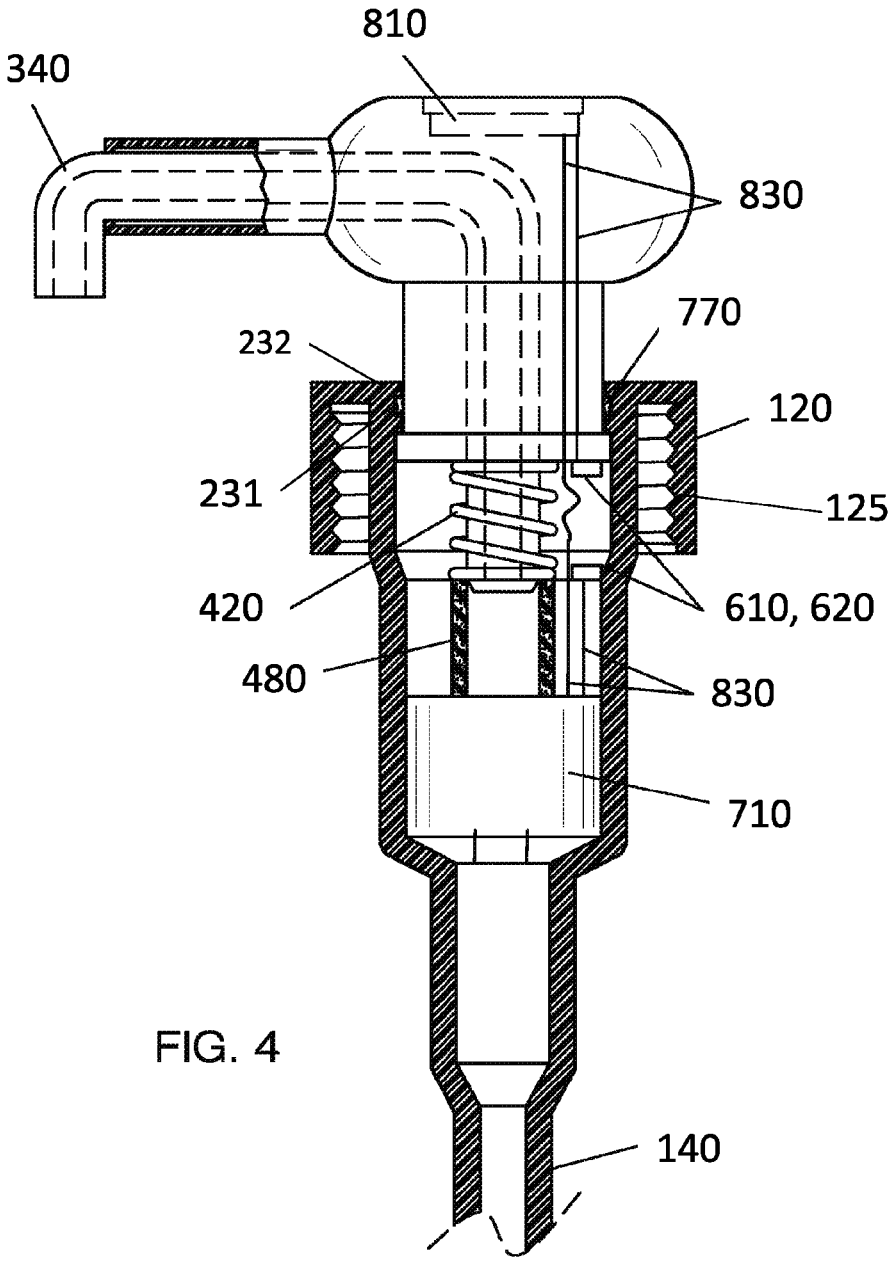
FIG. 4 is a first cross sectional view of the device of FIG. 1.
Figure 5:
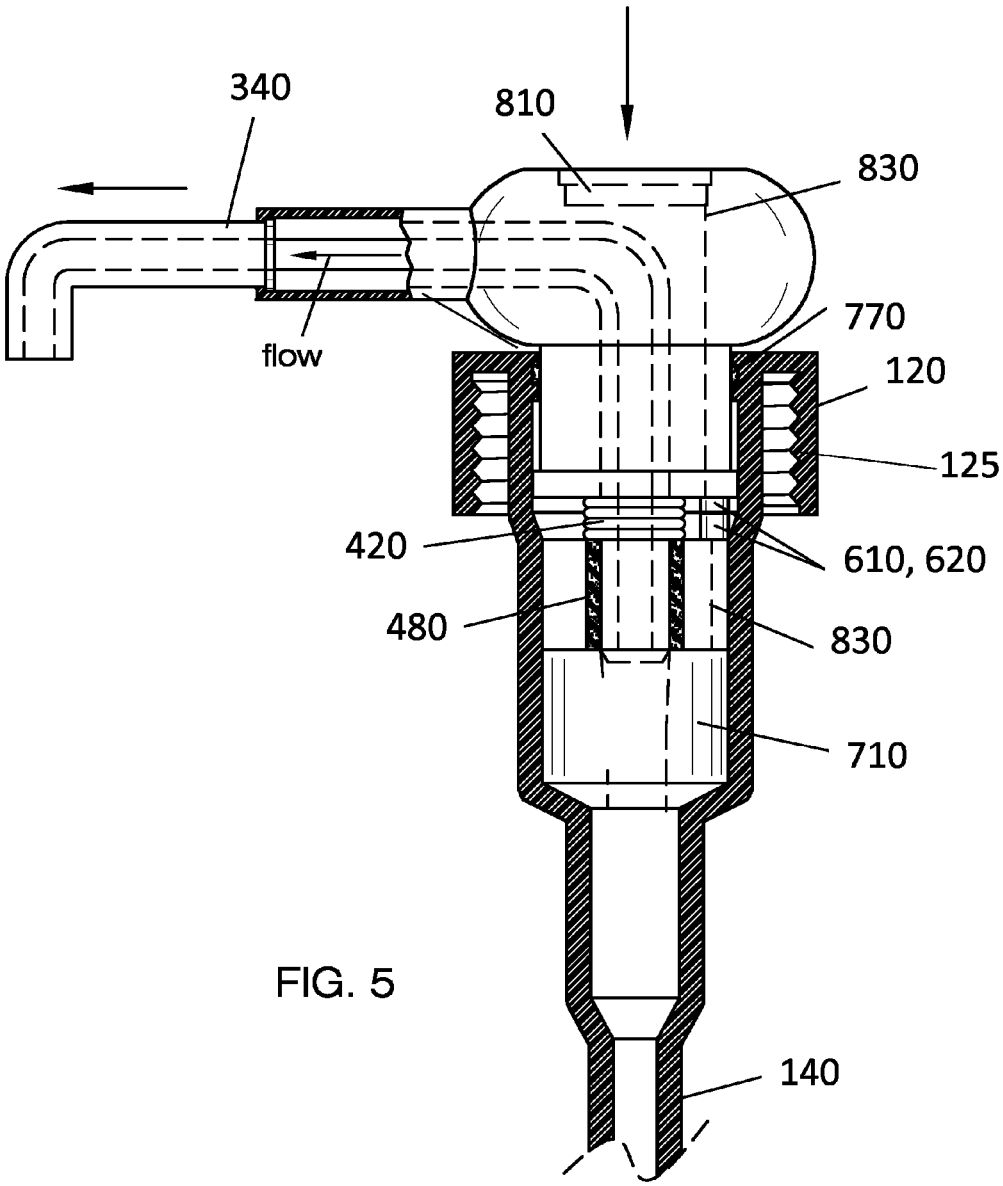
FIG. 5 is a second cross sectional view of the device of FIG. 1.

In some embodiments, moving the button 230 from the first position (shown in FIG. 4) to the second position (shown in FIG. 5) activates the electric pump 710. For example, a first set of contacts 610 may be disposed on the button 230 (e.g., inside the outer cylinder 120), wherein the first set of contacts 610 is operatively connected to the battery 810 (e.g., via wiring 830) and the first set of contacts 610 adapted to engage a second set of contacts 620 when the button 230 is moved to the second position (the second set of contacts 620 being operatively connected to the electric pump 710. FIG. 5 shows the sets of contacts 610, 620 engaged. When the sets of contacts 610, 620 are engaged, the power from the battery travels to the electric pump 710 and activates the electric pump 710. In some embodiments, the second set of contacts 620 is disposed on the electric pump 710. In some embodiments, the second set of contacts 620 is disposed elsewhere in the base 110 (see FIG. 4).

In some embodiments, the button 230 is biased in the first position caused by a spring 420. As shown in FIG. 4, the spring 420 may be disposed in between the conduit 480 of the base and the button 230.

The present invention is not limited to these mechanisms and components. The present invention may be made of different components and may function and work in different ways.

In some embodiments, the pump device 100 may further comprise a locking means for locking the button (e.g., so the button 230 cannot be moved between the first position and the second position). Locking means for buttons are well known to one of ordinary skill in the art. For example, locking means (e.g., lock down features, twist lock features) may be found on bottles of lotion (see U.S. Pat. No. 5,445,299 to Harriman). In some embodiments, the locking means of the pump device 100 of the present invention comprises a lock slot 231 that engages a lock tab 232. The lock tab 232 is disposed on the button 230 (e.g., the portion of the button 230 that engages the base 110). The lock slot 231 may be disposed in the base 110. When the lock tab 232 is in the lock slot 231, the button 230 cannot be used to pump liquid 109. In some embodiments, the button 230 can be turned (twisted), which moves the lock tab 232 in or out of the lock slot 231. In some embodiments, the button 230 can be pushed forwardly or backwardly to move the lock tab 232 in or out of the lock slot 231. In some embodiments, the button 230 can be pushed and then turned/twisted to move the lock tab 232 in or out of the slot 231. The locking means is not limited to the aforementioned examples. In some embodiments, one or more rubber seals 770 are disposed in the device 100, for example near the lock slots 231 (see FIG. 4).

The bottle cap pump device 100 may be constructed from a variety of materials and/or in a variety of sizes. In some embodiments, the device 100 is constructed from a material comprising plastic, metal, rubber, the like, or a combination thereof. In some embodiments, the device 100 is between about 0.5 to 1.0 inches in diameter. In some embodiments, the device 100 is between about 1.0 to 1.5 inches in diameter. In some embodiments, the device 100 is between about 1.5 to 2.0 inches in diameter. In some embodiments the device 100 is more than about 2.0 inches in diameter. The length of the device 100 may be of any appropriate size, for example, the length may be about the height of the bottle.

As used herein, the term "about" refers to plus or minus 10% of the referenced number. For example, an embodiment wherein the device 100 is about 2.0 inches in diameter includes a device 100 that is between 1.8 and 2.2 inches in diameter.

The following the disclosures of the following U.S. Patents are incorporated in their entirety by reference herein: U.S. Pat. No. 5,326,003; U.S. Pat. No. 6,851,584; U.S. Pat. No. 5,529,223; U.S. Pat. No. 4,667,856; U.S. Pat. No. 6,820,774; U.S. Pat. No. 4,595,121; U.S. Pat. No. 5,445,299.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pump device comprising:

(a) a generally cylindrical base for inserting into a top of a bottle, wherein an outer cylinder is disposed on a first end of the base, the outer cylinder comprises threads allowing the base and outer cylinder to be screwed onto the top of the bottle, the base comprises a base conduit;

(b) a straw disposed on a second end of the base and extending into the bottle, the straw is fluidly connected to the base conduit, wherein the straw serves as a conduit for liquid in the bottle to travel to the base conduit;

(c) a button slidably disposed in the first end of the base, the button can move between a first position and a second position, the second position corresponding to the button being pushed downwardly toward the straw, wherein the button is biased in the first position caused by a spring;

(d) a pump extension component disposed on the button and fluidly connected to the base conduit, the pump extension component serves as a conduit for liquid to travel out of the pump device, the pump extension component is adjustable in length;

(e) an electric pump disposed in the base, the electric pump functions to pump liquid from the bottle through the straw, through the base conduit, and through the pump extension component, wherein movement of the button from the first position to the second position activates the electric pump;

(f) a locking means for preventing the button from moving between the first position and the second position; and (g) a first set of contacts disposed on the button and operatively connected to a battery, wherein the first set of contacts is adapted to engage a second set of contacts operatively connected to the electric pump when the button is moved to the second position; wherein the first set of contacts and second set of contacts are biased in non-engaged position caused by a spring.

2. The pump device of claim 1, wherein bottle includes a 1 liter bottle, a 2-liter bottle, or a jug.

3. The pump device of claim 1, wherein the straw is between about 6 to 10 inches in length as measured from a first end to a second end.

4. The pump device of claim 1, wherein the straw is between about 10 to 13 inches in length as measured from a first end to a second end.

5. The pump device of claim 1, wherein the pump extension component is adjustable in length via a telescopic mechanism.

6. The pump device of claim 1, wherein the locking means comprises a lock tab disposed on a portion of the button that engages the base, the lock tab can engage a lock slot disposed in the base, wherein when the lock tab engages the lock slot the button cannot be moved to pump liquid.

* * * * *